US007980730B2

(12) United States Patent
Kufferath-Kassner et al.

(10) Patent No.: US 7,980,730 B2
(45) **Date of Patent: *Jul. 19, 2011**

(54) METAL MESH, ARRANGEMENT OF A METAL MESH AND METHOD FOR ILLUMINATION

(75) Inventors: Ingo Kufferath-Kassner, Dueren (DE); Stephan Kufferath-Kassner, Dueren (DE); Christop Kronhagel, Bonn (DE); Ralf Mueller, Much (DE)

(73) Assignee: Mediamesh GBR, Dueren (DE)

( * ) Notice: Subject to any disclaimer, the term of this patent is extended or adjusted under 35 U.S.C. 154(b) by 512 days.

This patent is subject to a terminal disclaimer.

(21) Appl. No.: 11/722,564

(22) PCT Filed: Jun. 2, 2006

(86) PCT No.: PCT/DE2006/000955

§ 371 (c)(1),
(2), (4) Date: Mar. 12, 2008

(87) PCT Pub. No.: WO2006/128447

PCT Pub. Date: Dec. 7, 2006

(65) Prior Publication Data

US 2009/0067173 A1 Mar. 12, 2009

(30) Foreign Application Priority Data

Jun. 3, 2005 (DE) ..... 10 2005 026 024
Mar. 29, 2006 (DE) ..... 10 2005 014 808

(51) Int. Cl.
*F21V 21/00* (2006.01)

(52) U.S. Cl. ..... 362/249.15; 362/249.06; 362/652

(58) Field of Classification Search ..... 362/249.15, 362/249, 252, 652, 249.04, 249.06, 249.08
See application file for complete search history.

(56) References Cited

U.S. PATENT DOCUMENTS

| | | | | |
|---|---|---|---|---|
| 4,001,778 | A * | 1/1977 | Ross | 340/908.1 |
| 5,601,361 | A | 2/1997 | Lawrence | |
| 5,709,462 | A | 1/1998 | Rumpel | 362/249 |
| 5,839,820 | A | 11/1998 | Huang | |
| 5,924,786 | A | 7/1999 | Lin | |
| 6,302,561 | B1 | 10/2001 | Huang | |

FOREIGN PATENT DOCUMENTS

| | | |
|---|---|---|
| CA | 2 306 683 | 10/2001 |
| DE | 33 32 536 | 3/1985 |
| DE | 298 01 292 | 6/1998 |
| DE | 299 06 622 | 7/1999 |
| DE | 299 17 014 | 12/1999 |
| DE | 100 65 695 | 7/2002 |
| DE | 10 2004 050 838 | 4/2006 |
| WO | 2004/019657 | 3/2004 |
| WO | 2006128447 A | 12/2006 |

* cited by examiner

*Primary Examiner* — Bao Q Truong
(74) *Attorney, Agent, or Firm* — Andrew Wilford

(57) ABSTRACT

An improved metal mesh with lights and an arrangement of such a mesh on a building are proposed. A light carrier receptacle is integrated in a mesh and thereby allow a light carrier to be removed from the mesh and reinserted without disintegrating the light carrier receptacle. Alternatively, a light carrier receptacle is attached to a mesh or other hanging, to which the light carrier is then attached. Clips can be preferably used.

29 Claims, 3 Drawing Sheets

METAL MESH, ARRANGEMENT OF A METAL MESH AND METHOD FOR ILLUMINATION

Figures 1, 2:
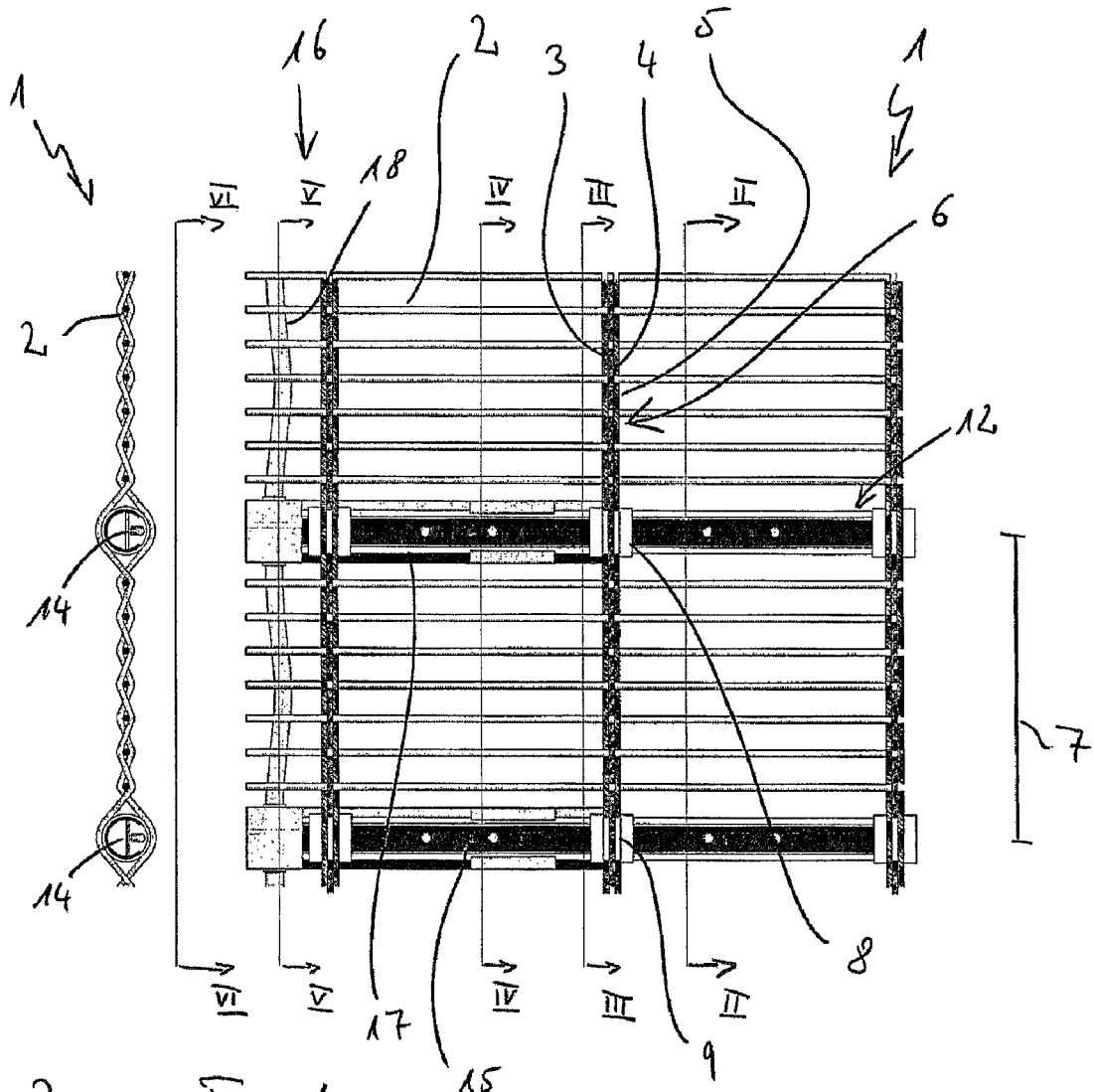

The invention relates to a metal mesh, an arrangement of a metal mesh and a method for illumination. In particular, the invention relates to a metal mesh with lights on a light carrier, the arrangement of a metal mesh on a building facade and a method for illumination of a façade or for creating a lighting effect visible from a large distance.

Lighting systems are usually used on numerous large as well as small scales. Probably the most impressive lighting systems are those of complete building facades which are being increasingly installed by lighting designers commissioned by cities and communities using specifically aligned spotlights. Other very striking lighting systems are large screen-like display elements which are capable of displaying pictures or films in a size of 10 m or more in some cases. The latter are popular for use at trade fairs or as advertising means.

The object of the invention is to provide an improved and variable system which can also be used in impressive sizes.

The object is achieved according to a first aspect of the invention by a metal mesh with lights on a light carrier, whereby a light carrier receptacle is integrated in the mesh, which allows the removal and insertion of the light carrier without disintegration of the light carrier receptacle.

Thus, this aspect of the invention initially proposes a metal mesh as a supporting structural element of the entire lighting system. It is understood that conventional mesh can also be used for this purpose; a metal mesh however has the special advantage that it is very stable and can be exposed to weather conditions without loss of stability. This makes it possible to arrange the metal mesh according to the invention on the outer side of a building, for example as a curtain in front of the entire facade of a building or a part thereof.

It is particularly emphasized that the invention can also be realized with a hanging having a structure other than a mesh, for example, with a braided structure, a knitted structure or laid structure, as well as with a material other than metal, in particular plastic. However, a particular advantage can be seen in a metal mesh since a very stable mesh can be produced but this retains a visually delicate appearance and thus gives a building architecture a particular elegance.

The metal mesh is intended to support lights on light carriers. Expressed differently, at least one light carrier is to be provided in the mesh which holds a plurality of lights.

In large meshes with lights, which are widely used for representative purposes, for example, on distinctive buildings in large cities, in view of the frequently exposed location, it is necessary toreplace defective lights with new, intact lights as quickly and cost-effectively as possible. This problem arises in all forms of lighting. Even with the use of LEDs, regular failures after a certain operating time of the lighting installation cannot be avoided. If, for example, a lighting installation on a building needs to be checked in such a manner, this involves a large amount of time and effort since access can frequently only be gained with the use of ladders from the outside or with considerable safety precautions from the inside of the building. Therefore, it is of great importance that the actual replacement of lights can be effected as easily as possible.

For this purpose, the aspect of the invention which has been put forward proposes a light carrier receptacle which is integrated in the mesh. This light carrier receptacle receives the actual light carrier in such a manner that removal and insertion of the light carrier from the light carrier receptacle or into the light carrier receptacle, is possible without disintegration of the light carrier receptacle. The lights themselves can then be separated from the mesh with the light carrier, while the light carrier receptacle remains therein as a genuine part of the mesh. Defective electrical or electronic components can then be replaced on the light carrier. Thereafter the functioning light carrier can simply be reinserted in the light carrier receptacle and if necessary connected in the manner provided and the original functionality of the mesh is restored.

Due to the fact that the light carrier receptacle can remain in the mesh as such, the structural stability of the mesh is guaranteed even when the light carrier is removed. The mesh as such is also already structurally complete with the presence of the light carrier receptacle and the light carrier can merely be inserted subsequently into the light carrier receptacle, that is added to the mesh If a metal mesh is used, it is advantageous to use stainless steel as the metal. Stainless steel is not only characterized by a particularly corrosion-resistant material quality, but also creates a reflection on the wefts and warps of the mesh for many light effects which pleasingly compliments the overall visual image of the lighting.

Particularly diverse light effects can be produced when a mesh possesses not only one light carrier but a plurality of light carriers at the same time. Each of these preferably has a plurality of lights. In this manner, the lights can be widely distributed over the mesh without difficulty, even in the case of simple geometry of the individual light carriers.

A plurality of light carriers are preferably arranged regularly over the mesh. Frequently, meshes are to be provided which create a special light effect which the viewer can see from a certain distance. This light effect can also consist in that the viewer is able to perceive a picture or film. For this purpose it is recommended to produce a grid of perceptible lights which is as uniform as possible. This can be achieved most simply in that the perceptible lights on a light carrier are provided a certain distance apart and that the plurality of light carriers vertical thereto are also arranged uniformly, preferably in the same grid width.

The lights are preferably individually adjustable via an electronic control system. In this manner, the lights can be individually turned on or off and also adjusted in brightness as desired. This not only makes it possible to create various static pictures or light effects over an area, but rather to also achieve a dynamic light effect so that, for example, a film can be produced by the lights on the mesh. It is merely a question of the distance of the viewer from the mesh and the grid density which determines the optical quality of this film—in the same way as a static picture—received by the viewer. Varying or even dynamic effects can be achieved as well, when only the single light carriers can be controlled individually or when groups of lights can be individually controlled. It is however understood that the greatest amount of flexibility is produced when the individual lights can be controlled.

Also in individually controllable lights it is proposed that a plurality of lights on a light carrier are each grouped into light groups. This makes it particularly possible to create a picture of the highest possible quality, particularly with colored lights for a viewer at a distance.

Different colored lights are necessary in order to produce a color film for the viewer or to produce a color picture with sharp contours for the viewer. Considering the rapid developments that have been made recently in semiconductor technology, light-emitting diodes in different colors, for example, can be used. For example, red, green and blue lights can be used on the mesh to create an almost unlimited number of different light effects for the viewer at a sufficient distance by selectively mixing the colors. This effect is known from a conventional CRT television.

Unlike the CRT televisions it is however to be taken into consideration that the individual pixels, which are represented by the lights of the light groups in the present mesh, have a different intensity, particularly when using light-emitting diodes. In experiments conducted by the inventor, it became clear that a very cost-effective and qualitatively satisfactory solution is to combine two red, two green and one blue LED each to form a group of lights. Then a plurality of light groups are provided on one light carrier where preferably each light group consists of two red, two green and one blue LED each—or a multiple thereof. The individual light groups are then preferably distributed on the light carrier at regular intervals. The light carriers are in turn preferably arranged at the same distance from one another over the mesh as the distance between two light groups. In this manner a very uniform grid with a wide range of color possibilities is created.

A particularly cost-effective solution from bus technology and conventional wiring can be achieved by providing on each light carrier an electronic control system for the lights of this light carrier. When, for example, the light carriers are each formed as rods and these rods run horizontally in mesh which is suspended or otherwise arranged, the light carriers to a certain extent form the lines of the complete picture. An electronic control system on the light carrier can therefore be referred to as the line control. This electronic control system then regulates the light conditions of the lights of this light carrier, that is, in the complete picture for example this line.

The line control as such can—particularly in the presence of a large number of single light carriers—be preferably controlled via a bus-system, so that only one cable connection is necessary which is guided along all electronic controls of the individual light carriers and controls same. Controlling the lights via the electronic controls can consist of simple wiring on the light carrier or again a bus-system as desired. In practice, this will in particular depend upon how long a light carrier is, how many lights it holds and how much room is available on or in the light carrier for wiring.

In any case it is of advantage if a light carrier is supplied with power and controlled at its front sides, particularly when this front side lies at the edge of the mesh. It was previously mentioned that a light carrier can particularly be configured in a rod form. In this manner it is easily possible and of particular advantage if such a rod-shaped light carrier replaces a weft wire in the regular mesh. In this manner a continuously uniform mesh is achieved in which the light carrier lies exactly in the mesh plane, which creates a particularly harmonious mesh surface. The light carrier then easily stretches exactly to the edge of the mesh so that the power supply and controls can be provided there inconspicuously and at the same time easily accessible.

In particular when the power supply is placed on the edge of the mesh, but not limited to this case, it is of advantage when one power distributor is guided along several light carriers and is provided with a plug connection to each light carrier. It is understood that in particular with the use of bus-technology a very inconspicuous current feed and control via such a central power distributor is possible. Through simple connection via a plug connection, the possibility of checking a single light carrier is not limited. Furthermore, in case of failure of a light carrier, the plug connection can simply be disconnected and the light carrier then pulled out of the light carrier receptacle. These steps can be carried out very rapidly.

A light carrier is preferably tubular. Particularly a straight pipe should be considered. Such a form offers not only a simple geometry, so that it can easily be inserted between two weft wires in the mesh and in particular can replace one of the weft wires. Furthermore the tubular shape makes it possible to arrange the lights within the tube so that these are protected from weather conditions and also to provide the wiring of the individual lights with one another or with a line controller within the tube.

If the lights are arranged within a tubular light carrier, it is understood that at least a part of the tube should be translucent. This makes it possible, despite the protected position within the tube, for the entire mesh to emit light perpendicular to the mesh surface or in any other directions if desired.

During the inventor's experiments, it has proven to be particularly suitable if the light carrier is a Plexiglass tube. Such a tube can be cost effectively produced, is relatively light and allows light emitted from the lights to escape in the desired direction almost unhindered.

When using large-area translucent light carriers, it is recommended to provide an opaque partial covering. Such a covering can serve to allow light emitted from the light carriers to escape in only one or in several specific directions. During the inventor's experiments, it has proven advantageous in Plexiglass tubes to use a thin-walled metal pipe with a lengthwise slit. This can, for example, be constructed as a very lightweight aluminum extruded profile which encompasses the Plexiglass tube—preferably in a clamp fitting—and allows the light to escape from the Plexiglass tube in exactly one direction perpendicular to the tube axis.

In such a construction, the Plexiglass tube with the lights can simply be inserted into the aluminum profile whereby there is no need to place great value on the arrangement of wiring, printed circuit boards or similar being unnoticeable within the Plexiglass tube. The aluminum profile in fact covers all of these necessary electronic elements and seen from the side facing away from the light-emitting side of the mesh depending on design, appears to be a conventional weft wire of the mesh. Even if the light carrier is larger in diameter than the rest of the weft wires, it still integrates harmoniously in the visual overall impression of the mesh. Furthermore, a Plexiglass tube acquires higher stability with such a metal covering so that, with large spans between two light carrier receptacles of a light carrier, the light carriers can be inserted better and with higher operating safety in the mesh, for example threading into the carrier receptacles.

Constructively, it is proposed that a light carrier receptacle is provided with a sleeve which is woven into the mesh. A sleeve can for example consist of a short piece of tube and is very cost-effective to produce. Furthermore, all sorts of complicated mechanisms are unnecessary which is of advantage, particularly in outdoor use during weather conditions, for the simple insertion and removal of light carriers. Furthermore, the sleeve can be easily integrated in the mesh. In this manner, it can be easily woven into a warp instead of a weft wire. A rod-shaped, in particular tubular light carrier can then be easily inserted into the sleeve from the side.

For good stability of the entire mesh and a safe attachment of the light carrier in the mesh, it is proposed that the sleeve-shaped light carrier receptacles are integrated in each warp of a weft. In this manner, over the entire structure of the metal mesh a weft wire is more or less replaced by a plurality of linearly aligned sleeves. The warps thereby retain their stability as if instead of the sleeves a somewhat larger or identically-sized weft wire had been woven in. In this manner the overall stability of the mesh is not influenced.

A sleeve provided as a light carrier receptacle preferably encompasses the light carrier with slight play. In this manner, the light carrier can particularly easily be pulled out laterally from the sleeves and thus from the mesh and later threaded in again. For threading in, it is advantageous if the sleeves are provided with a threading-in aid, for example a widening of the inner space toward the edge. Thus, the foremost front end of the light carrier, which is to be inserted from the side, can hang down slightly and still be pushed and threaded into the mesh from the side without invasion of the actual mesh area being necessary. Once it has reached its final position, it should be affixed to the edge of the mesh to prevent further movement. This can, for example, be arranged directly via the plug connection with the central power supply and controls.

So that the light carrier receptacle does not twist in its position when the light carrier is removed, it is proposed that the warps are joined together in odd-numbered groups. For example, a sleeve which is held in a single warp wire could possibly twist around the warp once the light carrier is removed. In a tensed mesh with two warps grouped together which hold the sleeve, this is necessarily the case, whereas this can also occur when several warps are grouped when the number of grouped warps is an even number. On the contrary, when the number of warps is uneven, a symmetrical force is exerted on the sleeve so that, with uniform stressing of the mesh, no twisting of the sleeve occurs. This also makes it possible to simply push the light carrier from the side of the mesh without needing to make corrective manual interventions in the mesh surface as such.

The described effect can be particularly easily achieved if three warps are grouped with each other.

In a second aspect of the invention, the object is achieved by a metal mesh (1) or a further particularly metallic hanging for a building, with lights (15) on a light carrier (12) and with a plurality of light carrier receptacles on a mesh (1) or other type of hanging, which makes the accommodation of the light carrier (12) and preferably also the removal of such possible.

A mesh or such a hanging manufactured in this manner is not as technically demanding as the alternative with receptacles integrated in the cloth, but however makes it possible to achieve large-illumination, particularly for a building.

If the receptacles hold the light carriers in a clamp fit, a sufficiently safe attachment can be achieved for most usage purposes.

If the illumination is to be effected via separate, fastened light carrier receptacles, it is proposed that the light carrier receptacles allow the light carrier to snap into place. Snap connection is a cost-effective fastening means and can be used for the fastening of light carrier receptacles themselves to the mesh or hanging as well as for fastening the light carrier to the light carrier receptacle.

Clips are particularly suitable for fastenings of this type, particularly made of plastic or of spring steel.

Depending of the specific requirements, it can be advantageous that removal is possible without destruction or only with a destruction of the clip.

It is understood that the previously mentioned advantageous embodiments of a mesh with integrated receptacles can also be advantageously implemented in a mesh or hanging with attached receptacles.

According to a third aspect of the invention, the object is achieved by an arrangement of a metal mesh or hanging with lights on a light carrier on a building façade. It has previously been explained how such a mesh or hanging can be used, also for large areas for representative and advertising purposes. For example, large office buildings or civil engineering works such as bridges, gates, dams, old town walls and an infinite number of further constructions can be equipped over a large area with such a metal mesh or with such a hanging. Of course it is also possible to equip natural areas with such a mesh or hanging, for example, cliff walls.

The entire system can be subjected to very severe mechanical loading and can be maintained cost-effectively since the individual lights can be checked without major problems and without danger for the operator. A metal mesh or hanging of the proposed type can be aligned so that the light is emitted away from the viewer side, for example, on a building facade where the lighting effects occur, for example, as a picture or film. On the other hand, the direction in which the light is emitted can also be directed toward the viewer. This creates a picture with little diffusion which, for example, can be advantageous for viewing from large distances.

In any case it is proposed that the weft of the mesh, in particular for large-area applications, be aligned horizontally. Particularly the weft is suitable for receiving rod-shaped light carriers so that at specific spacings to a certain extent, a weft wire is replaced by a light carrier. It is understood that such a rod-shaped light carrier can be easily removed from the mesh in a horizontal direction because this takes place while maintaining a working height. However, if, for example, a light carrier would have to be removed upward from the mesh, a larger working height would necessarily occur and an avoidable source of danger for the operator.

Furthermore, it is understood that the manufacture of a metal mesh with lights is made easier particularly for large-area applications. It is easily possible to weave the mesh in a conventional manner when manufacturing the metal mesh and to thereby integrate the mechanically very robust light carrier receptacles into the cloth. This is particularly obvious for example with sleeves that can be easily woven into the warps of a metal mesh.

In particular for this purpose, a method for producing a metal mesh is proposed where during manufacture of the mesh a structurally stable mesh of warp wires and partially weft wires and partially light carrier receptacles is produced whereby light carriers can be inserted subsequently, particularly pushed in, in the light carrier receptacles and therefore in the mesh The light carrier as such and the lights belonging thereto are normally manufactured by other companies and can be bought at a reasonable price. It is also possible for many producers to supply light carriers whereas it is only possible for a few producers to offer such large metal mesh with sleeves with which, for example, an entire building facade can be illuminated.

Not as technically demanding and usually more expensive to maintain but possibly with lower purchasing costs is a method of producing a metal mesh or hanging whereby during manufacture of the mesh or hanging a stable structure is produced and light carrier receptacles are attached on this structure via which light carriers can be received, particularly pushed in or connected thereto.

The invention will be further described hereinafter using an exemplary embodiment with reference to the drawings. In this case, components having the same function or identical components in different figures have the same reference numeral.

Figures 3, 4, 5, 6:
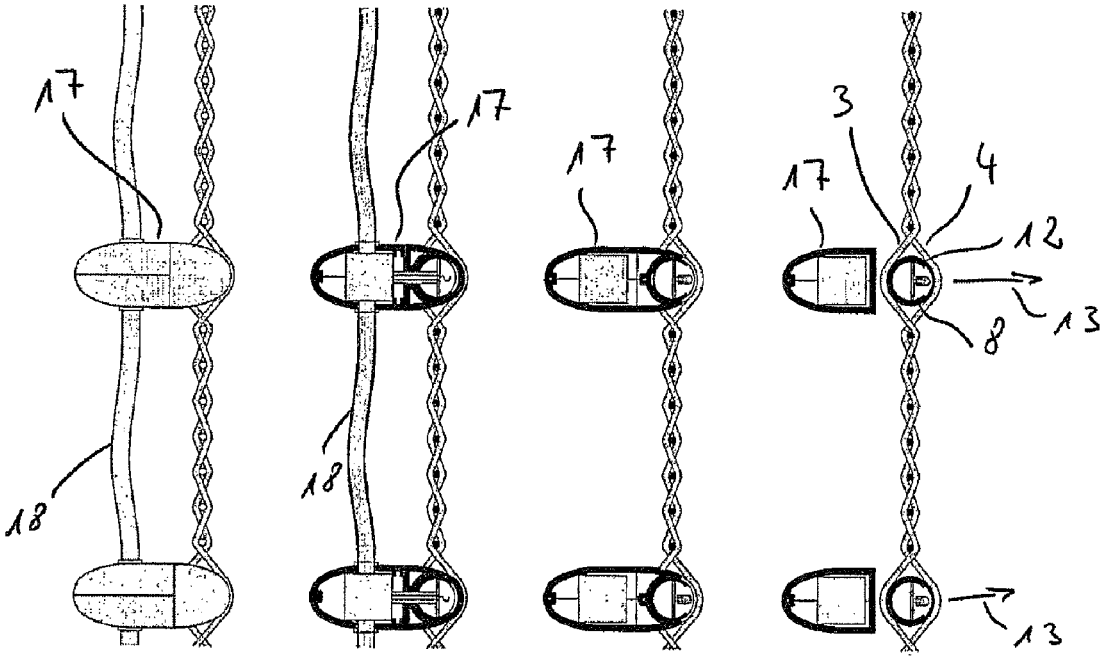
Figure 7:
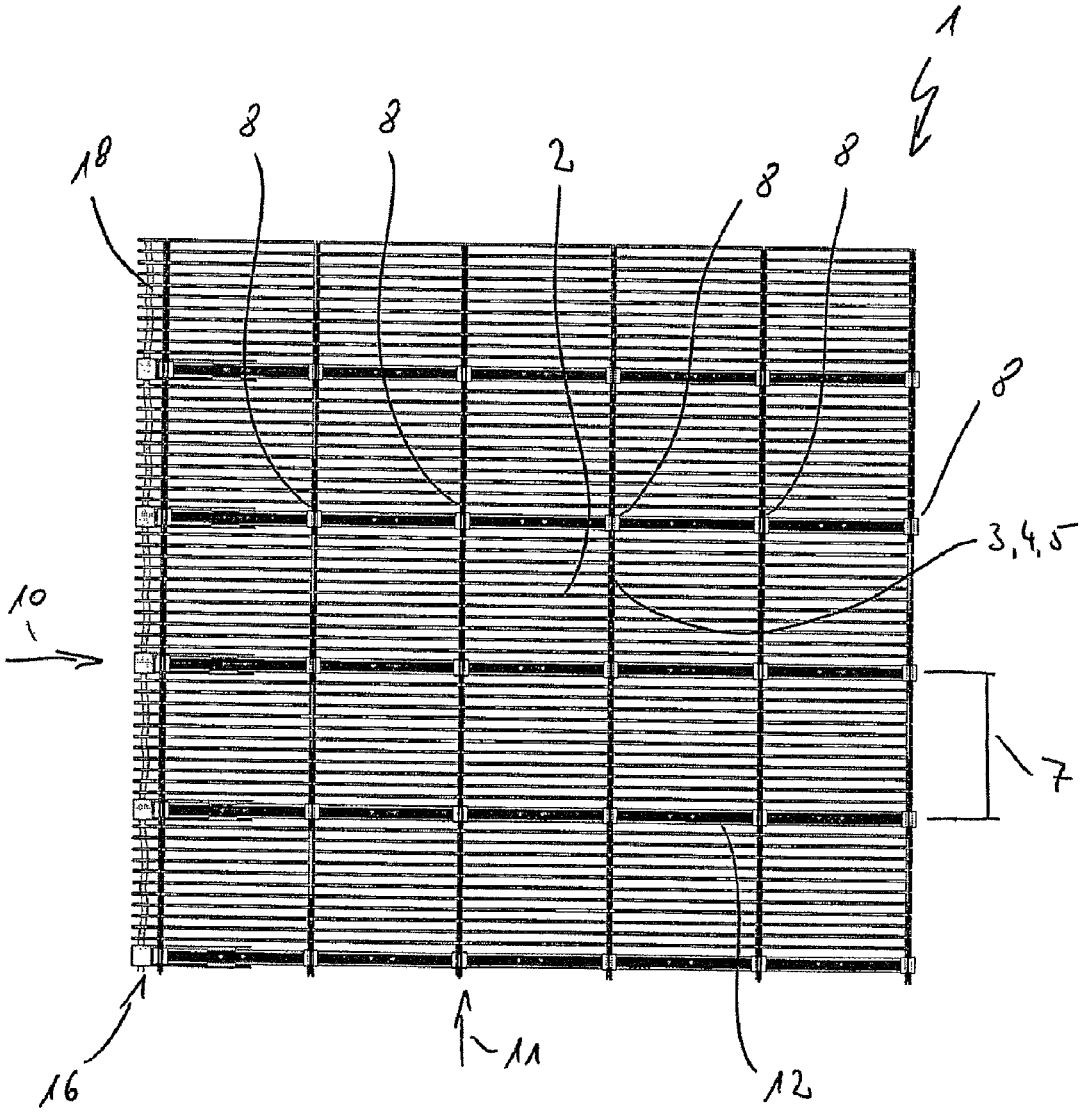

Shown is:

FIG. 1 a schematic plan view of a metal mesh according to the invention,

FIG. 2 a schematic side view according to reference II-II in FIG. 1,

FIG. 3 a schematic side view according to reference III-III in FIG. 1,

FIG. 4 a schematic side view according to reference IV-IV in FIG. 1,

FIG. 5 a schematic side view according to reference V-V in FIG. 1,

FIG. 6 a schematic side view according to reference VI-VI in FIG. 1, and FIG. 7 a larger view of a mesh according to the invention with a uniform light grid.

The mesh 1 in the figures structurally mostly consists of conventional weft wires (characterized as 2 as an example) and warp wires (characterized as 3, 4, 5 as an example). In this case, three warp wires 3, 4, 5 each are grouped together to form a warp 6. All together a very robust and weather-resistant and also aesthetically high-quality mesh structure is produced.

At regular distances (characterized as 7 as an example) the mesh 1 however does not contain the conventional weft wires 2 of stainless steel but instead where the "missing" weft wire 2 would normally be woven in, on each warp 6 a metal sleeve (characterized as 8 as an example) is woven in. The metal sleeves 8 are not made visible in the side views of FIGS. 2 to 6.

Each sleeve 8 has the basic shape of a piece of pipe, in which a circumferential groove (characterized as 9 as an example) is provided on the outer cover in which the warp wires 3, 4, 5 are inserted. Due to the grouping of three warp wires 3, 4, 5 each into a warp 6 and the conventional weaving in of the sleeves in the mesh 1, every sleeve 8 is surrounded on one side by the middle warp wires 4 and on the other side by the two outer warp wires 3, 5. If the mesh 1 is woven with pretension, the sleeves 8 are inserted firmly in the mesh 1. Due to the symmetrical loading of both warp wires 3, 5 on the one side of the sleeve and in particular the force from the middle warp wires 4 centered by the groove 9 on the other side of the sleeve, this is instantly aligned. Each sleeve 8 is held in the mesh 1 in this manner so that the axis of rotation, which runs through the empty inner space of the sleeve 8, lies exactly where the "missing" weft wire 2 would be in a conventional mesh.

The sleeves 8 are arranged as regularly as possible over the mesh 1, the warps 6 accordingly have about the same spacing as the spacing 7 between two "replaced" weft wires.

In a suspension of the mesh 1 as shown in the figures, sleeves 8 provided in lines (characterized as 10 as an example) and columns (characterized as 11 as an example) in a relatively uniform grid are thus obtained in the mesh 1.

A long tube 12 is pushed through the sleeves 8 of each line 10. Each tube 12 substantially consists of a Plexiglass tube with an extruded profile of aluminum which encompasses the Plexiglass tube over about three quarters of its circumference. The Plexiglass tube is clamped into the aluminum extruded profile and all the tubes 12 are aligned so that the resulting open slits along which the Plexiglass tubes are not covered by the aluminum, are all oriented in parallel alignment to one emitting direction 13 of the mesh 1.

Arranged inside each tube 12 are printed circuit boards (characterized as 14 as an example) on which five LEDs (characterized as 15 as an example) each are grouped, each comprising two red, two green and one blue LED. In this case, the LEDs 15 on the board 14 are grouped at a distance, so that the distance between two light groups along the line 10 corresponds as accurately as possible to the spacing of two warps 6 and therefore the distance between two columns 11. In this manner a most homogenous distributed grid of light groups is achieved.

On one edge 16 of the mesh 1 a compact housing 17 is connected to each light carrying pipe 12, which contains one electronic control each for controlling the different lights 15 of the tube 12 in a line 10. The electronic control in the housing 17 is supplied by a central power and control cable 18.

All together, the mesh 1 is capable of controlling the individual light-emitting diodes 15 in each line 10 and column 11, thus turning on, turning off or regulating the brightness in steps. If a viewer looks at the mesh 1 from a sufficiently large distance, he perceives a grid of light spots, whereby at a sufficient distance the groups of five light-emitting diodes appear as a single luminescent spot due to their small distance from one another in comparison to the rather large distance between the groups of lights in different lines or columns.

Therefore, if the distance between the viewer and the mesh 1 is large, an arbitrary static or dynamic picture can be presented to him. Depending on the fineness of the grid of lines 10 and columns 11 and the distance to the viewer quite sharp contours can be created. For example a mesh 1 is intended which covers a building façade having, for example, the dimensions of 100 m in height and 30 m in width, whereby the viewer is several hundred meters away and looks at the building.

Depending on the width of the lines 10 and columns 11 or also the thickness of the warp and weft elements 6, 2 the mesh 1 can, depending on the desired optical impression, either appear optically rather light so that the view of the façade behind the mesh can easily be seen by the viewer; or the mesh can be optically rather dense so that the viewer basically only registers the mesh and light spots 15.

In order to create the actual picture, the individual LEDs 15 of a tube 12 are highly dynamically regulated by an electronic line controller in a housing 17. A tube 12 thereby serves as a light carrier of the lights 15 of a line 10. The sleeves 8 however serve as receivers for the light carriers 12 in the mesh 1. These are firmly integrated in the mesh, through weaving into the warps 6.

The tubes 12 preferably lie within the sleeves 8 with slight play so that a tube 12 can easily be pulled out toward the side of the mesh 1 and can also easily be pushed back into the mesh 1, for example, to repair or replace a defective LED or line controller.

The mesh 1 preferably hangs exactly in the alignment depicted in the figures, each with a tube 12 in horizontal alignment. Even if there is too much play room for the tubes 12 in the sleeves 8, there is no danger that the tubes 12 could move sideways or actually slip out of the mesh 1. However, as a precaution in practice light securing measures should be applied to a pipe. This, for example, can take place on the edge of the mesh 16, for example, in that several tubes 12 or their line controllers 17 are attached to a central common power and control connection 18.

It is understood that a mesh of the previously described type can be utilized not only in such a manner that it is aligned directly in emitting direction 13 toward a provided viewer location. Rather, it can also emit light in the opposite direction, that is towards the façade of the building. Due to the emitting angle of in particular LEDs, a relatively gap-free illuminated picture can be created at a suitable distance from the facade whereby rather sharp contours are also obtained if the viewer maintains sufficient distance from the picture. It is naturally also possible to use the invention for producing soft or even blurry light effects. Such effects can already be created with a less dense grid size in the mesh and are therefore more cost-effective to manufacture and maintain.

The invention claimed is:

1. A metal mesh with lights on a light carrier wherein a light carrier receptacle is integrated in the mesh, making the removal and insertion of the light carrier possible without disintegration of the light carrier receptacle.

2. The metal mesh according to claim 1 wherein stainless steel is used as the material for warp wires or weft wires.

3. The metal mesh according to claim 1, wherein there are a plurality of the light carriers.

4. The metal mesh according to claim 3 wherein the light carriers are arranged regularly with respect to each other.

5. The metal mesh according to claim 1 wherein the lights are individually controllable via an electronic control system.

6. The metal mesh according to claim 1, wherein the lights are grouped in light groups on each light carrier.

7. The metal mesh according to claim 6, wherein one light group consists of two red, two green and one blue light.

8. The metal mesh according to claim 1, wherein light-emitting diodes are used as lights.

9. The metal mesh according to claim 1, wherein a line controller is arranged on a light carrier.

10. The metal mesh according to claim 1, wherein each light carrier structurally replaces one weft wire in the mesh.

11. The metal mesh according to claim 1, wherein one light carrier is supplied with power at a mesh edge.

12. The metal mesh according to claim 1, further comprising a current distributor is guided along a plurality of light carriers and connected thereto via a plug connection.

13. The metal mesh according to claim 1, wherein the light carrier is tubular.

14. The metal mesh according to claim 1, wherein the light carrier is at least partially translucent.

15. The metal mesh according to claim 14, wherein the light carrier (12) is a Plexiglass tube.

16. The metal mesh according to claim 14, wherein the light carrier comprises a partial cover.

17. The metal mesh according to claim 1, wherein woven-in sleeves form the light carrier receptacles.

18. The metal mesh according to claim 17, wherein the sleeves are woven into in each warp like a weft.

19. The metal mesh according to claim 1, further comprising warps arranged in groups with an odd number of warp wires.

20. A metal mesh or other metallic hanging for a building, with lights on a light carrier, comprising a plurality of light carrier receptacles arranged on the mesh or other hanging holding light carriers and also allowing the removal thereof.

21. The metal mesh or hanging according to claim 20 wherein the light carrier receptacles each have a snap connection for the respective light carrier.

22. The metal mesh according to claim 20 wherein the light carrier receptacles comprise clips.

23. An arrangement of a metal mesh or hanging according to claim 1 on a building facade.

24. A method for illuminating a building facade or for generating a light effect visible from a great distance with a metal mesh or hanging with lights on a light carrier into which a light carrier receptacle is integrated to make possible the removal and insertion of the light carrier possible without disintegration of the light carrier receptacle.

25. A method for producing a metal mesh with lights on a light carrier into which a light carrier receptacle is integrated to make possible the removal and insertion of the light carrier possible without disintegration of the light carrier receptacle wherein during production of the mesh a structurally stable mesh of warp wires and weft wires and light carrier receptacles is produced wherein in the light carrier receptacles and hence in the mesh light carriers can be inserted subsequently.

26. A facade hanging for a building, the hanging comprising:

a vertically and horizontally extending mesh made of vertical and horizontal metal filaments, having an upright side;

receptacles fixed to the filaments and forming an array of horizontal extending like passages opening at the side, the receptacles being sufficiently inflexible that the passages do not close from the weight of the mesh even when the passages are empty;

a plurality of elongated rod-like and partially transparent light carriers dimensioned to fit in the passages with sufficient clearance that the carriers can be inserted horizontally into and withdrawn horizontally from the passages;

a plurality of light groups spaced longitudinally in each of the carriers, each light group comprised of a plurality of light-emitting diodes of different colors;

a plug connection at an end of each of the carriers;

respective wiring between the connection and the diodes of the respective carrier; and a control system and power distributor extending along the side of the mesh and releasably connectable to the plug connections, whereby the plug connection of one of the carriers in a respective one of the passages can be disconnected from the power distributor and the one carrier withdrawn horizontally from the respective passage and another such carrier can be inserted thereinto and connected to the plug distributor in its place.

27. The façade hanging defined in claim 26, further comprising:

a plug connection at an end of each of the carriers and wiring between the connection and the diodes of the respective carrier; and a control system and power distributor extending along the side of the mesh and releasably connectable to the plug connections, whereby the plug connection of one of the carriers in a respective one of the passages can be disconnected from the power distributor and the one carrier withdrawn horizontally from the respective passage and another such carrier can be inserted thereinto and connected to the plug distributor in its place.

28. An architectural mesh, comprising:

a mesh panel comprising a plurality of interconnected wires and having opposing front and rear sides and transverse openings, said mesh panel being an open mesh having interstices between said interconnected wires on said front and rear sides; and at least one light element slidably received in one of said transverse openings, said at least one light element having a plurality of light emitter nodes emitting light through said interstices in said mesh panel on at least one of the front and rear sides.

29. A method of making an architectural mesh, comprising the step of:

providing a mesh panel of interconnected wires, the mesh panel having opposing front and rear sides and transverse openings, the mesh panel being an open mesh having interstices between the interconnected wires on the front and rear sides; and inserting at least one light element into a respective transverse opening through one end of said respective transverse opening, the at least one light element having light emitter nodes arranged to emit light through the interstices on one of the front and rear sides of the mesh panel.

* * * * *